US005600850A

United States Patent [19]

Shannon

[11] Patent Number: 5,600,850

[45] Date of Patent: Feb. 11, 1997

[54] MESH GARMENT FOR PROTECTION AGAINST INSECTS

[76] Inventor: Leonard K. Shannon, Rte. 3, Box 77, Winnsboro, S.C. 29180

[21] Appl. No.: 615,117

[22] Filed: Mar. 13, 1996

[51] Int. Cl.[6] ..... A41D 13/00

[52] U.S. Cl. ..... 2/69; 2/4

[58] Field of Search ..... 2/69, 2, 4, 84, 2/94, 202, 69.5, 206, 79, 227, DIG. 1, 1

[56] References Cited

U.S. PATENT DOCUMENTS

| | | | |
|---|---|---|---|
| 2,028,947 | 1/1936 | Palm . | |
| 2,074,390 | 3/1937 | Green . | |
| 2,924,455 | 2/1960 | Brunel . | |
| 3,191,185 | 6/1965 | Martin . | |
| 3,783,451 | 1/1974 | Malin . | |
| 4,422,184 | 12/1983 | Myers | 2/4 |
| 4,685,152 | 8/1987 | Heare . | |
| 4,716,594 | 1/1988 | Shannon . | |
| 4,985,933 | 1/1991 | Lemoine | 2/4 |
| 5,091,993 | 3/1992 | Merrill et al. . | |
| 5,119,510 | 6/1992 | Schilling . | |
| 5,150,476 | 9/1992 | Statham et al. | 2/81 |
| 5,214,797 | 6/1993 | Tisdale . | |
| 5,249,307 | 10/1993 | Lemoine | 2/4 |
| 5,274,849 | 1/1994 | Grilliot et al. | 2/81 |
| 5,357,635 | 10/1994 | Lemoine . | |
| 5,535,447 | 7/1996 | Stevens et al. | 2/4 |

FOREIGN PATENT DOCUMENTS

| | | |
|---|---|---|
| 267858 | 3/1976 | U.S.S.R. . |
| 884668 | 11/1981 | U.S.S.R. . |
| 825256 | 12/1959 | United Kingdom . |

*Primary Examiner*—C. D. Crowder
*Assistant Examiner*—Gloria Hale
*Attorney, Agent, or Firm*—Michael A. Mann, P.A.

[57] ABSTRACT

A garment for protection against insects comprising an inner layer of material onto which an outer layer of mesh is placed. The inner layer is formed having a plurality of arches to elevate the outer mesh layer a distance from the user's skin. The outer mesh layer is impervious to insects while the distance defined by the arches prevents the insect's stinger or proboscis from reaching the skin. In an alternative embodiment, the inner layer is also made of mesh with a series of heat shrinkable polymeric strands running therethrough which are heat-treated to cause the inner layer to form a series of arches.

12 Claims, 1 Drawing Sheet

MESH GARMENT FOR PROTECTION AGAINST INSECTS

BACKGROUND OF THE INVENTION

1. Field of the Invention

The present invention relates generally to protective garments. More particularly, the present invention relates to multi-layer garments that protect the user against insects.

2. Discussion of Background

Biting insects have always presented a problem for gardeners, bee keepers, campers, hikers, hunters, fishermen, and others who spend time outdoors. Common, aggressive insects include gnats, chiggers, ticks, black flies, bees, wasps, and mosquitoes. Besides being annoying and painful, the stings of these insects often transmit viruses and diseases, such as yellow fever and malaria and can cause allergic reactions in particular individuals.

In response to this nuisance, many chemical insect repellents have been created. These repellents attempt to alter or mask the natural scent of an individual so as to make it an unattractive target. One problem associated with their use is that chemical repellents wear out over time and become ineffective when subjected to moisture, water, or perspiration. Consequently, these repellents must be reapplied frequently. Moreover, harsh chemicals contained within them often irritate the individual's eyes and skin.

Another solution advanced by the art to protect an individual against insects is the use of protective garments. Most of these garments are designed to create a distance between the individual's skin and the top surface of the garment, so that an insect's stinger or proboscis cannot reach the individual's skin. For example, U.S. Pat. No. 5,357,635 describes a beekeeper's suit that is comprised of an inside layer and an outside layer, both made of a net material. Positioned between the inside and outside layers is a cellular layer. The thickness of the cellular layer prohibits the insect's stinger from penetrating the skin of the individual.

U.S. Pat. No. 5,214,797 also discloses a garment using a foamed or cellular material in conjunction with a mesh layer. With this design, the foamed material is formed in strips and sewn into the underside of the mesh fabric. U.S.S.R. Patent Number 884,668 describes a protective shirt/jacket that is composed of two individual garments. The undershirt is made of a netted material having loops of polyamide thread between the columns of netted weaving. The overshirt is woven in a particular manner so that the polyamide loops form wedge-shaped cells between the undershirt and outershirt.

U.S. Pat. No. 4,685,152 teaches a garment made of a mesh material that protects the entire body. The jacket is fitted about the shoulder area with a yoke made of a heavy cotton material that adds additional protection. The technique of gathering is applied at the extremities of the jacket and about the perimeter of the yoke. This gathering creams a series of "puckers" or ridges in the mesh material, which serves to define a distance between the mesh and the individual's skin.

There remains a need for an insect protective garment which is lightweight, flexible, breathable, and maintains its protective nature despite vigorous activity by the wearer.

SUMMARY OF THE INVENTION

According to its major aspects and briefly described, the present invention is a protective garment which provides protection against insects. The garment comprises an inner layer of material having a series of arches and a top layer of a mesh material placed over the inner layer. The outer layer of mesh provides a barrier impenetrable by insects, while the distance defined by the arched inner layer is greater than the length of the insect's stinger or proboscis. The arches of the inner layer can be formed by the gathering, pleating, or embroidering. In a prefected embodiment, the inner layer is made of mesh material having a plurality of heat shrinkable strands woven into the mesh. When heated treated, the strands thermally deform within the mesh, causing it to gather by puckering and thereby create the arches.

In one embodiment, the inner layer and the outer layer are separate; that is, they are not attached to each other. In use, the inner layer serves as an innershirt and innerpants. When protection against insects is desired, the outer layer of mesh is placed over the undershirt and underpants to form an insect impervious barrier. Alternatively, the inner and outer layers may be sewn together to form a single garment.

A major feature of the present invention is the combination of an arched inner layer and the outer mesh layer. The boundary defined by the outer mesh and its distance from the user's skin as a result of the arched inner layer provides effective protection against black flies, gnats, bees, wasps, chiggers, "no-see-ums", yellow jackets and mosquitoes.

Another feature of the present invention contained in a preferred embodiment is the use of heat shrinkable strands interwoven within an inner mesh layer. The use of these strands enables the inner layer to be made of a lightweight mesh material and still form a series of arches without a complicated manufacturing technique. The resulting garment is lighter, more flexible and particularly suited for hot or tropical environments.

Other features and advantages will be apparent to those skilled in the art from a careful reading of the Detailed description of a preferred embodiment accompanied by the following drawings.

DETAILED DESCRIPTION OF A PREFERRED EMBODIMENT

The present invention is a garment for protection against insects. In particular, the present invention protects an individual from being bitten or stung by bees, wasps, yellow jackets, chiggers, black flies, gnats, "no-see-ums," ticks, and mosquitoes. It is recognized that although the detailed description makes reference to use of the present invention to protect people, the present invention can also be used to protect both domestic and farm animals.

Figure 1:
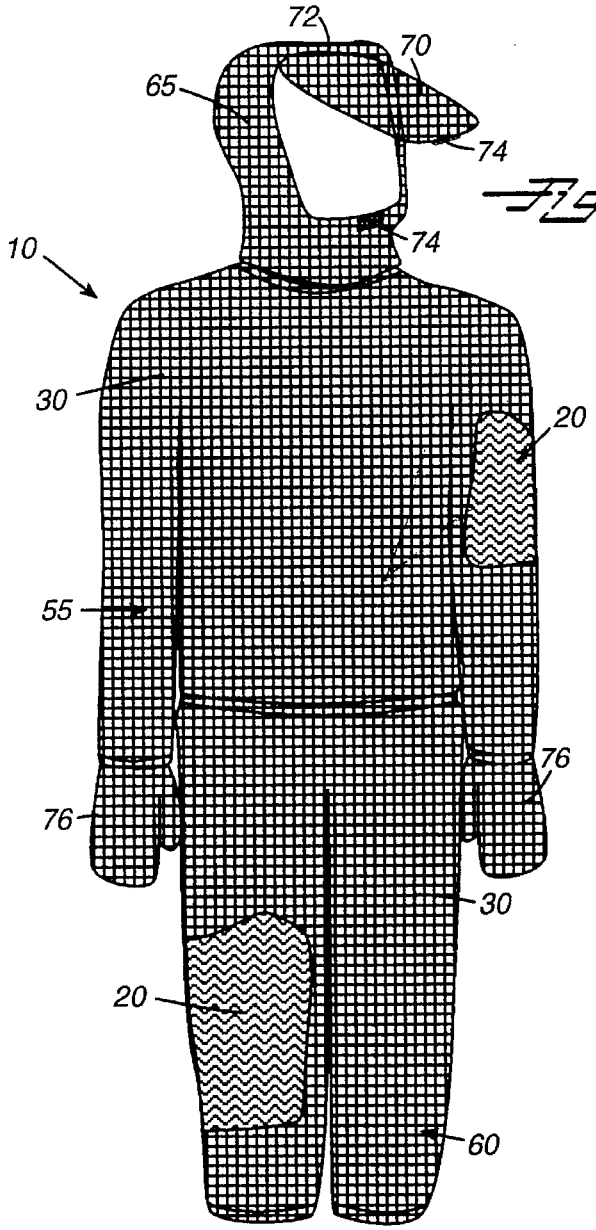
FIG. 1 is a front, partial cut-away of a protective garment according to a preferred embodiment of the present invention.
Figure 2:
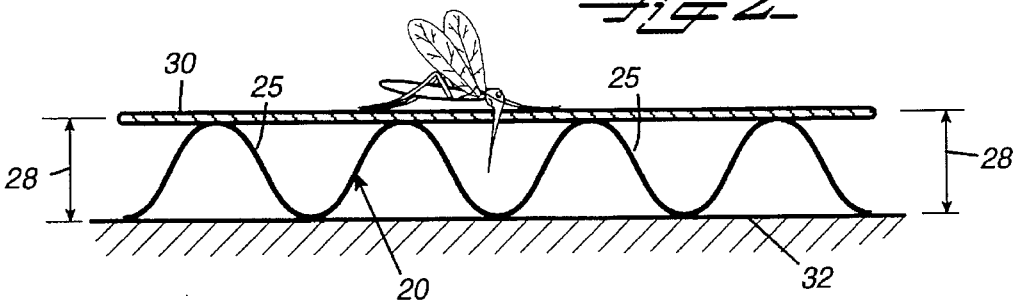
FIG. 2 is a cross-sectional view of a protective garment according to a preferred embodiment of the present invention.

Referring now to FIGS. 1 and 2, there is shown a frontal view and a cross-sectional view, respectively, of the present invention, indicated generally by reference numeral 10. Garment 10 comprises an inner layer 20 and an outer layer 30.

Outer layer 30 can be made of any material having threads close enough together to form a barrier through which the insect cannot pass. Preferably, outer layer 30 is made of a mesh fabric. Mesh is a light weight material having superior ventilation characteristics and the capability of preventing the passage of insects completely through the fabric. Normally, the distance between the strands of a mesh material is no greater than approximately 1/16 of an inch to ensure that the majority of insects are incapable of passage. In an alternative embodiment, outer layer 30 is made of a particular brand of mesh entitled NO-SEE-UM™. NO-SEE-UM™ mesh is made of a finer, more closely knitted arrangement of threads having superior breathing characteristics and is almost completely impervious to smaller insects, such as chiggers and no-see-ums.

Inner layer 20 can be made of any breathable material which can be formed to assume a series of arches or puckers, as will be discussed below, and which is comfortable next to the skin. Such materials include, but are not limited to, cotton, cotton-polyester blends, mesh, and rayon.

Inner layer 20 is formed to have a series of equally spaced arches 25, each of which has a height 28. Arches 25 elevate outer layer 30 a distance from the user's skin 32 to prevent the proboscis or stinger of an insect from contacting skin 32. Consequently, the user is protected from the bites and stings of various insects. In order to protect the user from the majority of aggressive insects, height 28 should be no less than approximately 1/16 of an inch.

Methods by which inner layer 20 can be formed to assume a series of arches 25 are well known in the art of garment making. Such methods include, but are not limited to, embroidering, gathering, and pleating.

Figure 3:
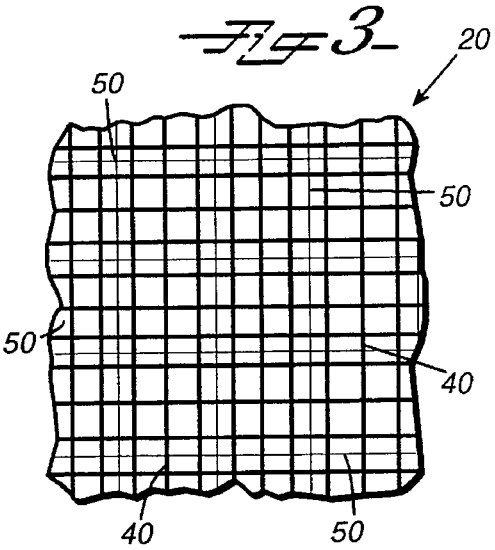
FIG. 3 is a top view of an inner layer of a protective garment according to an alternative preferred embodiment of the present invention.

Referring now to FIG. 3, there is shown a top view of a preferred embodiment for forming inner layer 20. Inner layer 20 is comprised of a mesh material 40 and a plurality of heat shrinkable yarn strands 50. Strands 50 can be any heat shrinkable yarn, but preferably is made of polyester. Strands 50 can be woven into mesh material 40 using any method commonly employed in the art. The spacing of strands 50 within mesh material 40 will depend upon the types of yarns used, and therefore will require a modest amount of experimentation commonly conducted by one with ordinary skill in the art of garment making. Once yarn strands 50 are woven into mesh material 40, the fabric is subjected to a heat treatment. Subjecting the fabric to heat results in the thermal deformation or constriction of strands 50, which in turn causes mesh material 40 to gather, or "pucker", and thus form arches 25.

As shown in FIG. 1, garment 10 includes a jacket 55 and pants 60. In one embodiment, inner layer 20 and outer layer 30 may be sewn together to form an integral garment 10. It is preferred that inner layer 20 be stitched to outer layer 30 only at the seams so as to create a loose-fitting garment that can be used when engaging in outdoor activities such as hunting, fishing, and gardening.

Alternatively, garment 10 may be comprised of separate components, with the inner layer 20 acting as an innershirt and innerpants, while outer layer 30 will function as an overshirt and overpants. With this embodiment, an individual may use the inner layer 20 as a normal outdoor garment. When it becomes apparent to the individual that aggressive insects are in the vicinity, outer layer 30 can be put on over inner layer 20, thereby creating protective garment 10.

Garment 10 may also contain a hood 65 having a face shield 70. Hood 65 is of the same construction as jacket 55 and pants 60, that is; hood 65 contains an inner layer 20 and an outer layer 30. Attachment of hood 65 to jacket 55 may be made by any method commonly employed in the art of garment making. Alternatively, jacket 55 and hood 65 may be made of a single piece of inner layer 20 and outer layer 30.

Face shield 70 is comprised of a single layer of outer layer 30 and is attached to hood 65 along top 72. In use, face shield 70 is rotated over the face of the wearer and is held in place by hook and pile fasteners 74. It is appreciated that other fasteners can be substituted for hook and pile fasteners 74. Such fasteners include, but are not limited to, zippers and drawstrings. When it is desired to remove face shield 70 from the front of one's face, it is rotated about top 72 and comes to rest on hood 65. Garment 10 may also contain protection for the hands in the form of gloves or mittens 76.

It will be apparent to those skilled in the art that many modifications and substitutions can be made to the preferred embodiment just described without departing from the spirit and scope of the invention as defined in the appended claims.

What is claimed is:

1. A garment for protection against insects comprising:

an outer layer of mesh material, said outer layer of material preventing the passage therethrough of said insects; and an inner layer of material, said inner layer of material having a series of arches, each arch of said series of arches having a height greater than or equal to approximately 1/16 of an inch, said arches elevating said outer layer from the skin surface of the wearer so that said insects cannot bite said wearer.

2. The garment as recited in claim 1, wherein said inner layer is sewn to said outer layer.

3. The garment as recited in claim 1, wherein said inner layer is made of cotton.

4. The garment as recited in claim 1, wherein said inner layer is made of a cotton and polyester blend.

5. The garment as recited in claim 1, wherein said inner layer is made of mesh.

6. A garment for protection against insects comprising:

an outer layer of mesh material, said outer layer of material preventing the passage therethrough of said insects;

an inner layer of material, said inner layer of material having a series of arches, each arch of said series of arches having a height, said arches elevating said outer layer from the skin surface of the wearer so that said insects cannot bite said wearer, said height being greater than or equal to 1/16 of an inch; and stitching, said stitching connecting said inner layer to said outer layer.

7. The garment as recited in claim 6, wherein said inner layer is made of cotton.

8. The garment as recited in claim 6, wherein said inner layer is made of a cotton and polyester blend.

9. The garment as recited in claim 6, wherein said inner layer is made of mesh.

10. A garment for protection against insects comprising:

an outer layer of mesh material, said outer layer of material preventing the passage therethrough of said insects; and an inner layer of mesh material, said inner layer of material having a series of arches, each arch of said series of arches having a height, said arches elevating said outer layer from the skin surface of the wearer so that said insects cannot bite said wearer.

11. The garment as recited in claim 10, further comprising stitching, said stitching connecting said inner layer to said outer layer.

12. The garment as recited in claim 10, wherein said height is greater than or equal to approximately 1/16 of an inch.

* * * * *